United States Patent [19]

Etienne

[11] Patent Number: 4,684,263

[45] Date of Patent: Aug. 4, 1987

[54] MAGNETIC BRAKE FOR TIMEPIECE

[75] Inventor: Georges Etienne, Peseux, Switzerland

[73] Assignee: ETA S.A. Fabriques d'Ebauches, Granges, Switzerland

[21] Appl. No.: 904,588

[22] Filed: Sep. 8, 1986

[30] Foreign Application Priority Data

Oct. 2, 1985 [CH] Switzerland ..... 04248/85

[51] Int. Cl.[4] ..... G04B 19/02; G04B 29/00

[52] U.S. Cl. ..... 368/220; 368/223; 368/322

[58] Field of Search ..... 368/76, 80, 220, 223, 368/228, 322–326

[56] References Cited

U.S. PATENT DOCUMENTS 3,978,654 9/1976 Koike et al. ..... 368/80

FOREIGN PATENT DOCUMENTS 410706 3/1925 Fed. Rep. of Germany .

1276205 10/1961 France .

*Primary Examiner*—Vit W. Miska

*Attorney, Agent, or Firm*—Pollock, Vande Sande & Priddy

[57] ABSTRACT

A magnetic brake for a timepiece including a seconds wheel and a fixed magnet. The wheel is fashioned from magnetic steel. The magnet is located in vicinity of the wheel periphery and radially offset with respect to the teeth thereon.

8 Claims, 1 Drawing Figure

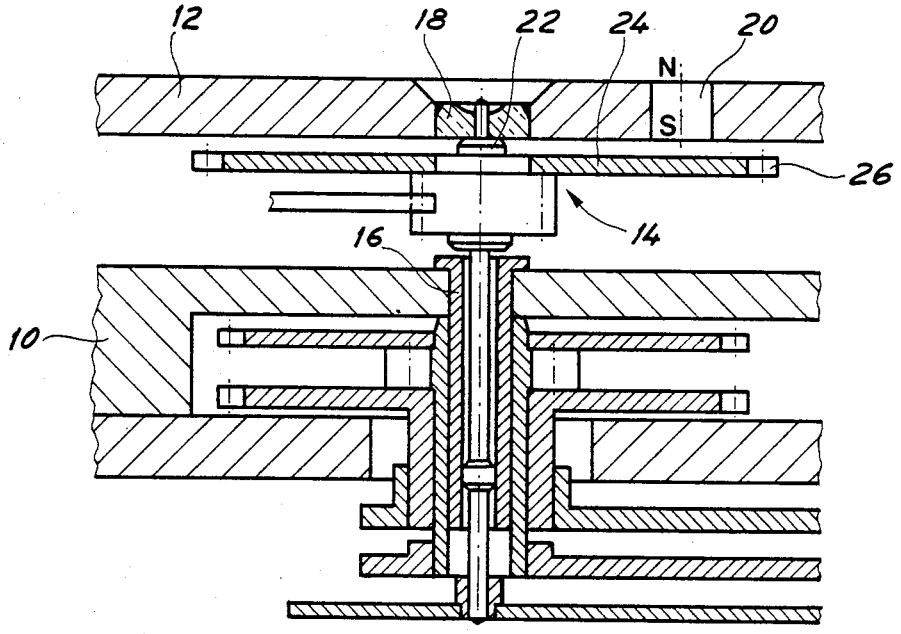
12
18
22
24
20
N
S
26
14
16
10

MAGNETIC BRAKE FOR TIMEPIECE

The object of the present invention is to provide a brake for the wheel train of a timepiece which includes a seconds wheel. In particular it concerns a magnetic-type brake with a fixed magnet.

BACKGROUND OF THE INVENTION

In watches with a seconds wheel and in particular electronic watches provided with a stepping motor, it is noted that the seconds hand oscillates at the end of a motor pulse and stops elsewhere than directly opposite the indices on the dial. This phenomenon is due to the play in the gearing. It is encountered in particular in watches where the motor drives the seconds wheel through one or several intermediate wheels. One finds a similar behaviour in mechanical watches of the type referred to as indirect center seconds. In order to eliminate such unaesthetic operation, it has already been proposed to provide a brake on the seconds wheel. Usually, this brake is obtained by means of a spring working on the end of a pivot. Unfortunately, such an arrangement takes up space in the thickness of the watch. Presently the thickness of watches is an important parameter and this solution is therefore no longer practicable.

It has likewise been proposed to obtain mechanical braking by placing a magnet in the neighborhood of the axle of the seconds wheel in a fashion to increase the rubbing force of this wheel turning in its bearing. This solution likewise leads to the difficulty of requiring space in the thickness.

In one case as in the other, the pivoting of the seconds wheel is lubricated. Consequently, the friction is above all of the viscous type,. i.e. increasing as a function of the speed.

There results therefrom a considerable increase of the braking couple during driving of the wheel train for a very small increase in the positioning couple. It can thus be said that energy consumption increases in a substantial manner for a small result.

The purpose of the invention is to obtain a wheel train brake which requires no additional space in the thickness of the timepiece and generating a braking couple assuring a good positioning of the seconds hand without any noticeable increase in the consumption of energy.

SUMMARY OF THE INVENTION

The aforesaid purpose is attained thanks to the fact that the seconds wheel is made of magnetic steel and in that the magnet is located in vicinity of the periphery of this wheel and radially offset with respect to the teeth thereof.

It has been effectively determined that in a surprising manner the placing of a magnet at the periphery of a wheel formed of magnetic steel enables the realization of a particularly efficient brake from the point of view of wheel positioning, at the same time consuming only a small amount of energy. To the present time the man skilled in the art sought to employ a magnetic material which was as soft as possible (small coercive field) and a magnet as close as possible to the center in a manner to have an attractive force as high as possible in order to generate a friction couple.

In the arrangement according to the invention, one is led to believe that the braking is above all due to the fact that the steel of the wheel in the neighborhood of the magnetic at each displacement if the wheel runs through a complete hysteresis cycle. It is known that the coercive field of steel is greater than that of soft iron. The breaking couple seems thus to be generated above all by magnetic phenomena; it scarcely varies with the speed. There results therefrom than for the same positioning effect the increase of the energy consumption is less with a steel wheel than with one made of soft iron.

On the other hand, the fabrication in steel rather than in soft iron provides numerous advantages from the manufacturing viewpoint. It is effectively well known that soft iron is difficult to machine, easily gives rise to burrs and is deformed at the least shock, this rendering the teeth unusable. On the other hand, steel is readily machined and, especially when it is hardened, resists shocks.

DESCRIPTION OF THE DRAWING

The single FIGURE represents a brake in accordance with the invention associated with a watch partially shown.

DESCRIPTION OF THE PREFERRED EMBODIMENT

On the FIGURE may be seen a base plate 10, a bridge 12 and a seconds wheel 14 pivoting in the bridge 12 and the base plate 10.

More precisely, base plate 10 includes a hole in which is fitted a tube 16. Bridge 12 includes a hole in which there is fitted a jewel 18 itself provided with a hole coaxial with tube 16. Tube 16 and jewel 18 comprise the bearings for the wheel 14. Bridge 12 includes furthermore a hole displaced relative to jewel 18 and in which is a magnet 20 with axial magnetization advantageously fastened by pressing. Such magnet 20 is of a thickness substantially equal to that of bridge 12. It is of cylindrical form and of a diameter substantially equal to that of the hole in order that it may be press fitted therein. Wheel 14 includes shaft 22 and has a solid disc portion 24. The shaft 22 which bears a pinion as well as the disc portion 24 are of steel. Disc portion 24 is pressed and riveted onto shaft 22. The periphery of the disc portion 24 bears teeth 26. The distance between the axis of wheel 14 and the axis of the magnet 20 is such that the latter is located in vicinity of the periphery of wheel 14 but radially offset with respect to the teeth 26 of such wheel 14.

Trials have been effected with watch movements provided with seconds hands which exhibit a positioning default. This default has been due to the play of the gearing and of rebounds of the wheel train at the end of a motor pulse. In order to suppress this defect, such movements have been transformed by providing them with a seconds wheel in steel and a magnet driven into the hole in the bridge. More precisely, the seconds wheel of a diameter of 2.2 mm and of a thickness of 0.10 mm is formed of hardened steel Sandwik 14P (hardness 530 HV). This type of material has a coercive field substantially equal to 50 Oe and a remanent induction in the neighborhood of 9000 G. The magnet is of platinum cobalt of a diameter of 0.30 mm, a length of 0.50 mm, pressed into the bridge, the distance between the axis of the wheel and the axis of the hole being 0.82 mm. The distance between the magnet and the wheel (the gap) is equal to 0.12 mm.

Comparative measurements have been made with non-transformed movements, i.e. provided with a seconds wheel of brass. In these movements a braking couple was obtained by a foil of 0.03 mm thickness bent in a spring form and interposed between the hours wheel and the dial. These measurements have shown that the dispersion of the position of the seconds wheel was reduced by a factor of three for the movements equiped with the magnetic brake described above. On the other hand, variations of the other parameters such as consumption, useful couple or functioning limits, have not been evident in any significant manner. In all cases they do not exceed a few percent.

Other types of steel may be employed to obtain the disc portion of the wheel. At the same time, to obtain a satisfactory result, it appears desirable that their coercive field be comprised between 10 Oe and 100 Oe. If the coercive field is too weak, the braking couple is reduced. If, on the other hand, it is too strong, the magnet no longer permits running through the complete hysteresis cycle.

According to the situation, one might choose a different type of magnetic material. As a general rule, materials with a high coercive field such as anisotropic ferrites, platinum cobalt and materials based on rare earths, are the best adapted.

In all cases, the magnet, the wheel and the distance separating them are chosen in a manner such that the steel aligned with the magnet is close to saturation. Practical trials have shown that satisfactory results are obtained with a cylindrical magnet the length of which is about twice that of its diameter and with a wheel, the thickness of which is substantially equal to the gap, this latter being three to six times less than the length of the magnet. Such dimensional relationships are applicable if the magnet is of platinum cobalt. Should another material be employed, the dimensional relationships must be modified as a function of the characteristics of the material and in particular of its coercive field and remanent induction. More precisely, the length and the diameter may be respectively reduced with an increase of the coercive field and the remanent induction.

In the case of watches of small dimensions, platinum cobalt is particularly well adapted in spite of its high cost. It has as the advantage of not being sintered from whence there results a very high mechanical resistance and a good machinability permitting pressing of the magnet without risk of breakage thereof.

Trials have been effected with a watch movement. It is well evident that the solution as described is likewise usable in timepieces of greater volume.

What I claim is:

1. A magnetic brake for the wheel train of a timepiece including a seconds wheel having teeth on the periphery thereof, said brake comprising a fixed magnet and said seconds wheel, said wheel being separated from said magnet by a gap and fashioned from magnetic material having a coercive field of between 10 Oe and 100 Oe, said magnet being located in the vicinity of the wheel periphery and radially offset toward the wheel axis with respect to the teeth thereon, and the distance across said gap and the magnetic properties of said magnet and the magnetic properties of said wheel being such that displacement of said wheel about its axis provides braking of said wheel train.

2. A magnetic brake as set forth in claim 1 wherein the magnet is of hard magnetic material with high coercive field.

3. A magnetic brake as set forth in claim 2 wherein said magnet is of platinum cobalt.

4. A magnetic brake as set forth in claim 1 wherein said wheel is of hardened steel.

5. A magnetic brake as set forth in claim 2 wherein the magnet is in the form of a cylinder the diameter of which is about half the length thereof, and wherein the gap is provided between one end of the cylinder and the wheel, the length of the gap being substantially equal to the thickness of the wheel and one third to one sixth the length of the magnet.

6. A magnetic brake as set forth in claim 1 wherein the magnetic properties of said magnet and said wheel are such that the material of the wheel in the neighborhood of the magnet runs through a complete hysteresis cycle upon each displacement of the wheel.

7. A magnetic brake as set forth in claim 1 wherein the magnetic material of said wheel comprises a magnetic steel.

8. A magnetic brake as set forth in claim 1 wherein the distance across said gap and the magnetic properties of said magnet and said wheel are such that the magnetic material of said wheel aligned with said magnet is close to saturation.

* * * * *